US006300602B1

(12) United States Patent
Platt et al.

(10) Patent No.: US 6,300,602 B1
(45) Date of Patent: Oct. 9, 2001

(54) LIGHT RING DISPLAY FOR COOKTOP

(75) Inventors: Nils Platt, New Bern, NC (US); Hans Daerendinger, La Mirada, CA (US)

(73) Assignee: BSH Home Appliances Corporation, Huntington Beach, CA (US)

( * ) Notice: Subject to any disclaimer, the term of this patent is extended or adjusted under 35 U.S.C. 154(b) by 0 days.

(21) Appl. No.: 09/579,387

(22) Filed: May 26, 2000

(51) Int. Cl.[7] ..... H05B 3/68
(52) U.S. Cl. ..... 219/445.1; 219/464
(58) Field of Search ..... 219/445, 464, 219/449, 446.1, 502, 451.1; 156/242

(56) References Cited

U.S. PATENT DOCUMENTS

| | | | | |
|---|---|---|---|---|
| 3,632,983 | * | 1/1972 | Dills | 219/464 |
| 3,870,862 | * | 3/1975 | Doner | 219/464 |
| 4,237,368 | * | 12/1980 | Welch | 219/449 |
| 4,251,716 | * | 2/1981 | Lewis et al. | 219/446 |
| 4,794,233 | | 12/1988 | Goessler et al. . | |
| 4,868,371 | * | 9/1989 | Crossley et al. | 219/464 |
| 4,983,810 | | 1/1991 | Balderson . | |
| 4,990,750 | | 2/1991 | Martel et al. . | |
| 5,013,893 | | 5/1991 | Goessler et al. . | |
| 5,138,135 | | 8/1992 | Husslein et al. . | |
| 5,185,047 | * | 2/1993 | Ray | 156/242 |
| 5,448,036 | | 9/1995 | Husslein et al. . | |
| 5,571,434 | * | 11/1996 | Cavener et al. | 219/464 |
| 5,658,478 | * | 8/1997 | Roeschel et al. | 219/502 |
| 5,928,543 | * | 7/1999 | Davis et al. | 219/451.1 |
| 6,133,552 | * | 10/2000 | Saulnier et al. | 219/446.1 |

FOREIGN PATENT DOCUMENTS

2187836A * 7/1987 (GB) .

* cited by examiner

*Primary Examiner*—Teresa Walberg
*Assistant Examiner*—Leonid Fastovsky
(74) *Attorney, Agent, or Firm*—Brooks & Kushman P.C.

(57) ABSTRACT

A method and apparatus for illuminating a heated area on a cooktop panel includes a light ring peripherally aligned about a burner under the cooktop panel, a gasket for resiliently retaining the tube beneath the cooktop panel and a support for resiliently engaging the gasket against the panel. Preferably, the light ring is a tube recessed within the gasket to avoid direct contact with the cooktop panel surface. The gasket may also restrict illumination to a channel portion of the gasket. Alternatively, the tube can be coated to avoid illumination in directions other than the area exposed to the panel. The gasket forms a convenient masking tool for delineating the surface area of the tube that is to be exposed while shielding other exterior surfaces of the tube. Both the illuminator and the method for illuminating the burner are simplified when the gasket includes a support flange beneath the tube retaining socket.

16 Claims, 1 Drawing Sheet

LIGHT RING DISPLAY FOR COOKTOP

TECHNICAL FIELD

The present invention relates to cooktops in which burners are supported beneath a cooktop glass or ceramic panel and having a heated area light tube exposed to the panel.

BACKGROUND ART

Cooktops have been developed in which radiant heating elements are mounted beneath a glass or ceramic panel. Such panels prevent contamination of the heating elements and provide a continuous surface that is easy to clean and enhances the appearance of the appliance in which the cooktop is mounted. However, while radiant heating elements typically radiate light as well as the heat for cooking, pans placed on the top surface of the panel obscure the visibility of the radiant light, particularly when a cooking pan is centered over the heating element for efficient heating. Moreover, even though electrical power to the heating element may have been shut off, the heating element may still remain hot even though the heating element does not radiate a visible indication of its temperature. Accordingly, previously known cooktops have employed a heat indicator lamp near the heating element or in the area of a control panel for the cooktop to indicate that a surface area of the cooktop remains at a high temperature. However, light displays that are small or only near to a portion of the heated area or in the case of placement in the control zone remote that may be from the heated area, such illumination does not provide a complete visual depiction of the heated area where inadvertent contact should be avoided.

Several problems must be overcome in order to improve the size of the area to be illuminated to more nearly correspond with the heated area. Increasing the surface area of the lighting subjects a large number of illuminating elements or substantial surface areas of large lighting elements to cyclic heating and cooling and the incident stresses and strains of such cycling. Moreover, the use of large lighting elements can illuminate substantially more than the surface area visible to the user, and may illuminate the entire interior of the appliance below the cooktop panel. Such illumination may detract from the appearance of the appliance as it illuminates far more details of the interior construction of the appliance than may be desirable. Moreover, proper positioning of the light at the heated area often requires special construction of the heater support or other mounting in order to incorporate the illumination at the heated area. Moreover, attempts to control illumination often resulted in the use of increasingly permeable coatings or thermochromic materials on the cooktop panel to control illumination through the heat radiating surface. Alternatively, multiple light sources may be employed at a particular area and selectively illuminated depending upon the temperature range of the heated area. Such illumination controls substantially increase the cost of the appliance and subject a substantially greater number of parts and surfaces to the stresses and strains of cyclic heating.

DISCLOSURE OF INVENTION

The present invention overcomes the above-mentioned disadvantages by providing an illuminator for heated zones on a translucent cooktop in which a tubular lamp is curved and positioned beneath the cooktop panel to peripherally depict a burner area on the cooktop panel. The tubular lamp is mounted in a gasket retained against the cooktop panel by the burner support. The gasket exposes a portion of the tube to the panel while pliably engaging the panel surface and may recess the lamp from contact with the panel to avoid breakage during shipping, handling or when objects are dropped on the panel. Similarly, the present invention provides a method for aligning light transmission through a translucent cooktop panel by inserting a tubular light in a gasket having raised walls defining a channel, positioning the channel in exposed alignment to the cooktop panel and supporting the gasket beneath the cooktop panel, the gasket being resiliently engaged against the surface of the cooktop panel.

In a preferred embodiment, a tubular lighting element suggests, such as a tubular neon bulb curved to fit about the periphery of a heating element, is retained in a gasket of opaque material. The gasket includes a pair of walls that define an open topped channel dimensioned to receive the tube and expose a peripheral portion of the tube. Preferably, the channel is formed as a socket to resiliently engage a large portion of the tube while the top portion of the tube remains exposed through the channel to the cooktop panel, although recessed from the surface of the panel. A gasket also includes a mount, preferably an inverted channel adapted to receive a support bracket flange extending from the periphery of a heating element support. Preferably, the gasket is made of a silicone foam which can be pliably or resiliently engaged against the cooktop panel.

Alternatively, or in addition, the light tube may be opaquely coated over a substantial portion of its surface so that the illuminating area is limited by the coating on the bulb and may not require opaque gasket material. In a preferred method of coating a bulb, the bulb may be prefit into a gasket and the assembly is subjected to an application, preferably by spraying, of a masking material covering an exposed surface portion of the bulb. The bulb may be removed from the gasket and then coated with an opaque material. After coating, the masking layer on the tube is removed so that the area of illumination is aligned toward the cooktop surface regardless of the gasket material or support used to position the light ring under the cooktop surface.

BRIEF DESCRIPTION OF DRAWINGS

The present invention will be more clearly understood by reference to the following detailed description when read in conjunction with the accompanying drawing in which like reference characters refer to like parts throughout the views, and in which.

DETAILED DESCRIPTION OF THE PREFERRED EMBODIMENT

Figure 1:
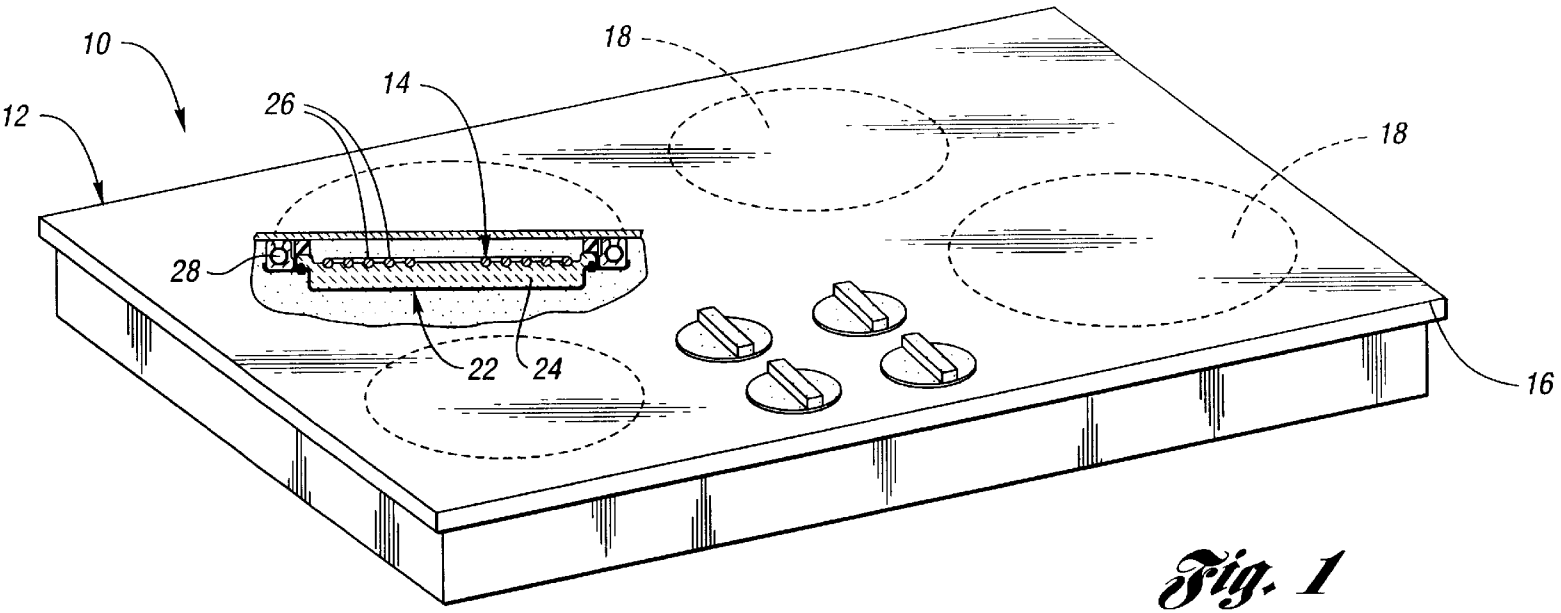
FIG. 1 is a perspective view of an appliance having a cooktop and including an illuminator according to the present invention.

Referring first to FIG. 1, an appliance 10 according to the present invention includes a cooktop 12 having four heating radiant or conduction type elements 14 below a ceramic panel 16, although the heater elements and cooktop surface may be enhanced, for example, to induction heater elements below a glass range, without departing from the present invention. Although a plurality of heater elements 14 are shown in the preferred embodiment, it is to be understood that at least one such heater only is required to form a cooktop, and that the cooktop may include other heating appliances, such as grills or the like, without departing from the scope of the present invention. In addition, the panel 16 is translucent, although as used in this disclosure, the term translucent refers to any panel having light transmission capability from a slightly permeable medium up to and including a transparent medium, and may include opaque areas as well as light transmitting areas, without departing from the scope and spirit of the present invention so long as an area on the heated surface portion is of the panel 20 provides some degree of passage of light.

Beneath each heated area 18, a support pan 22 forms a receptacle that receives a heater 14. In the preferred embodiment, the heater 14 includes a ceramic body 24 carrying radiant heating elements 26. The pan 22 may be supported upon and mounted to a shelf 27, preferably by a resilient member 29 such as a leaf spring, a coil spring or other resilient retainer.

The illuminator of the present invention is peripherally aligned at the heated area 18 and comprises an elongated, curved light element such as a curved neon filled tube, configured to designate a boundary in alignment with the heated area 18. Although other light sources may be used, such bulbs are preferred since they provide high intensity illumination that may be readily visible through the cooktop panel 16. A lighting filament within the curved tube lamp 28 is coupled through a temperature sensitive switch 30 to a power line 32 so as to close the circuit and illuminate the tube when a temperature of the area 18 is above a predetermined threshold value. Of course, the switch 30 may be part of a control mechanism or processor for operating the appliance, and may include substantially more complex arrangements, such as variable position switches which change the energy delivered to the bulb depending upon the temperature range detected at the heated area 18. In any event, the switch 30 may be carried on the heater as shown at 31, or incorporated in the electronic control or in the processor control as desired.

Figure 2:
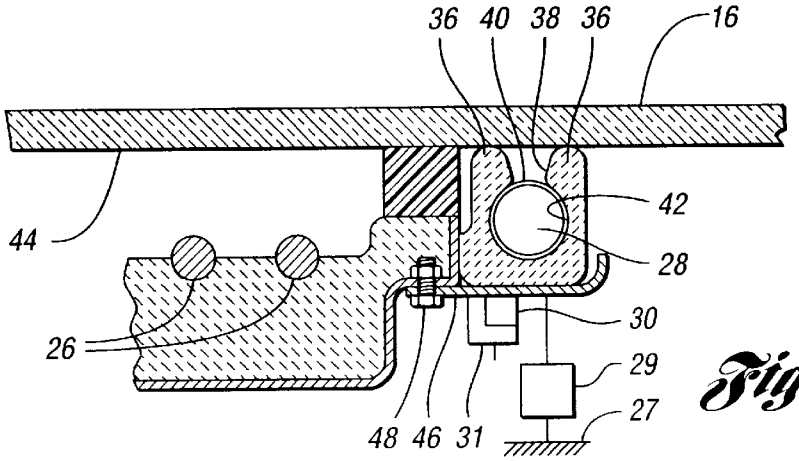
FIG. 2 is an enlarged, cross-sectional view of an illuminator as shown in FIG. 1.

Referring now to FIG. 2, the tube lamp 28 is carried in a gasket 34 made of pliable, resilient material. Preferably, the gasket 34 includes a pair of walls 36 forming a channel 38 through which a portion of the peripheral surface of the tube 28 is exposed to the panel 16. The exposed surface portion 40 may be limited by the opaqueness of material composition of the gasket 34 or otherwise by coating as described below. Preferably, the channel 38 is formed as a socket 42 that resiliently engages the lamp 28 and retains it in a position recessed from but exposed to the panel 16. The profile of the gasket shown in FIG. 2, preferably formed from a silicone compound, offers some insulation from the heat generated at the adjacent heater 14. In addition, a composition such as silicone foam is stable to a temperature up to 250° C. and is soft enough to mount easily over the glass tube even when formed as continuous extrusion cut to the length of the glass tube 28. In addition, metal, such as springs clamping the heaters, or the support ledges 46 or 60, are shielded from the lamp by the gasket 34, to avoid affecting illumination of the tube as adjacent metal retainers would affect the lamp, and cradling the tube 28 for handling and installation.

The gasket 14 may likewise be formed in a ring conforming with the shape of the lamp 28, although it is to be appreciated that the pliable nature of the material enables a straight extrusion to be employed as a support gasket 34. Gasket 34 may be made of silicon type material, and preferably a foam, so that it pliably engages and conforms with the lower surface 44 of the panel 16 by a support such as a support flange 46 which may be bolted, adhered or otherwise supported or integrated with the ceramic heater body 24 or its support pan 22. As shown in FIG. 2, a flat flange is held by sheet metal screw 48 threadedly engaged within the support pan, the walls 36 rising to a position at which the walls 36 engage and meet with surface 44 on panel 16. Nevertheless, the walls 36 are dimensioned so as to recess the tube 28 below the surface and avoid contact due to jarring, vibration or damage from dropped items landing on the panel. The gasket 34 also prevents inadvertent contact between substantially different temperature components that may otherwise cause premature breakage.

The gasket 34 need not be opaque and may also be formed from light transmitting material. However, in such a case, it is preferable to otherwise limit exposure of the illumination throughout the interior of the appliance. Preferably, exposure is controlled by coating the periphery of the tube 28 to block the flow of light except at the exposed area 40. While such coating may be applied independently of the installation of the tube 28 in the gasket 34, the pliable gasket 34 also forms a convenient production tool as well as a final support for the lamp tube 28. In particular, when the tube is prefit into the socket 42, the exposed area 40 may be covered by spraying a masking material, for example, a paint release agent, or otherwise applying a removable mask layer such as a tape, within the scope of the invention. The mask layer preferably cures in position so that it is not inadvertently removed when the tube is removed from the gasket 34. The tube 28 is then removed so that the entire exterior of the tube can be coated with an opaque, light blocking layer such as paint. After the tube 28 is coated, the masking layer is removed from the exposed area 40 so that light will be emitted from the tube only in alignment with the panel 16. As a result, illumination rings surrounding the burner area 18 is easily illuminated with the tube while avoiding unsightly illumination of the interior components of the appliance.

Figure 3:
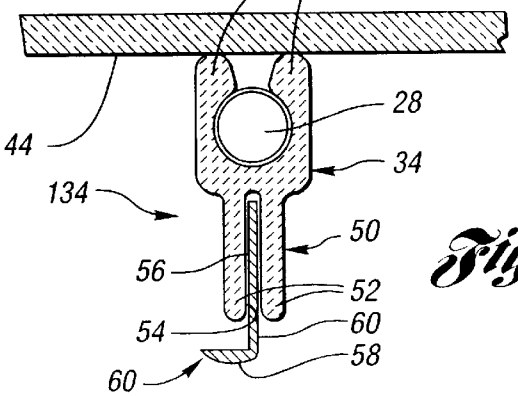
FIG. 3 is an enlarged sectional view similar to FIG. 2, but showing a modification of the illuminator according to the present invention.

Referring now to FIG. 3, a gasket 134 includes not only the tube retaining portion 34, but also a retainer flange 50. The retainer flange includes a pair of walls 52 that define a channels 54 between them. Channel 54 resiliently engages the sides of a flange 56 extending outwardly toward the panel 16 from a laterally extending leg 58 of a bracket 60 welded or otherwise secured to the support pan 22. Preferably, a plurality of support legs 60 including support flange 56 and a leg flange 58 are peripherally dispersed around the burner support pan 22 as shown by the flanges 46 circumferentially positioned about the burner as shown in FIG. 1. As a result of the mating engagement between the legs 36 and the panel surface 44, the pressure of engagement may be easily adjusted by bending a bracket 60.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An illuminator for a translucent cooktop panel comprising at least one heating element area, the illuminator comprising:

a tubular lamp curved to peripherally border said at least one heating element area;

a gasket including raised walls defining an open topped channel dimensioned to receive said tube and expose a peripheral portion of said tube, said raised walls extending above the periphery of said tube; and a mount for securing said gasket at said heating element area with said raised walls in engagement with a surface of said cooktop panel.

2. The invention as described in claim 1 wherein said gasket includes a retainer formed by a socket in said channel.

3. The invention as described in claim 1 wherein said tube includes an opaque coating on a substantial surface portion and a translucent surface portion.

4. The invention as described in claim 3 wherein said translucent surface portion is aligned to face said cooktop panel.

5. The invention as described in claim 1 wherein said gasket is formed as a pliable, resilient extrusion.

6. The invention as described in claim 5 wherein said gasket is a silicone foam compound.

7. The invention as described in claim 1 wherein said tubular lamp is a neon lamp.

8. The invention as described in claim 1 wherein said gasket includes a support flange.

9. The invention as described in claim 8 wherein said support flange comprises a pair of depending walls spaced apart by a support channel.

10. A method for aligning light transmission through a translucent cooktop panel comprising:

inserting a tubular light in a gasket having raised walls defining a channel, positioning said channel in an alignment exposed to said cooktop panel, and supporting said gasket beneath said cooktop panel with said raised walls in engagement with a surface of said cooktop panel.

11. The invention as described in claim 10 and further comprising, after said inserting step, masking a portion of said tube by coating an exposed portion of said lamp with a masking agent, removing said tube from said gasket, coating said tube with an opaque coating, releasing said opaque coating at the masked portion of said tube, and inserting said tube in said gasket with said exposed portion aligned in said channel.

12. The invention as described in claim 10 and wherein said inserting step comprises cradling said tube in said gasket.

13. The invention as described in claim 10 and comprising separating said tube from said cooktop panel by said raised walls.

14. The invention as described in claim 10 and shielding said tube except at an area aligned with said channel.

15. The invention as described in claim 14 wherein said shielding comprises inserting said tube in an opaque gasket material.

16. A method for illuminating a translucent cooktop panel comprising fixing a position of a tubular bulb and focusing illumination by:

inserting a tubular light in a gasket having raised walls defining a channel, said raised walls exposing a surface portion of said tubular light, said surface portion being less than half the diameter of said tubular light, and supporting said gasket beneath said cooktop panel with said surface portion facing said cooktop panel.

* * * * *